US005361459A

United States Patent [19]

Hyvonen et al.

[11] Patent Number: 5,361,459

[45] Date of Patent: Nov. 8, 1994

[54] CLIP ASSEMBLY

[75] Inventors: Tapani Hyvonen, Turku; Tarmo Maenpaa, Salo, both of Finland

[73] Assignee: Nokia Mobile Phones Ltd., Finland

[21] Appl. No.: 7,593

[22] Filed: Jan. 22, 1993

[30] Foreign Application Priority Data

Jan. 23, 1992 [FI] Finland ..... 920297

[51] Int. Cl.[5] ..... A44B 21/00; A45F 5/00

[52] U.S. Cl. ..... 24/35; 24/3 F; 24/510; 224/269

[58] Field of Search ..... 24/3 J, 3 F, 3 R, 509, 24/510, 511; 224/252, 269

[56] References Cited

U.S. PATENT DOCUMENTS

| | | | |
|---|---|---|---|
| 2,397,780 | 4/1946 | Emde | 24/3 F |
| 2,418,410 | 4/1947 | Hull | 24/3 F |
| 3,808,642 | 5/1974 | Nation | 24/3 F |
| 4,083,481 | 4/1978 | Selinko | 24/3 R |
| 4,536,925 | 8/1985 | Boothe et al. | 24/511 |
| 4,635,836 | 1/1987 | Mooney et al. | 224/247 |
| 4,741,074 | 5/1988 | Budano, II et al. | 224/269 |
| 4,780,934 | 11/1988 | Vickers et al. | 24/3 J |
| 4,828,153 | 5/1989 | Guzik et al. | 224/269 |
| 4,881,150 | 11/1989 | Oyamada | 361/392 |
| 4,956,895 | 9/1990 | Hayasaka | 24/3 R |
| 5,016,326 | 5/1991 | Goldenberg | 24/3 J |
| 5,052,081 | 10/1991 | Fuehrer | 224/252 |

FOREIGN PATENT DOCUMENTS

| | | |
|---|---|---|
| 920297 | 9/1992 | Finland . |
| 2199886A | 7/1988 | United Kingdom . |
| 2252786A | 8/1992 | United Kingdom . |

*Primary Examiner*—Victor N. Sakran
*Attorney, Agent, or Firm*—Perman & Green

[57] ABSTRACT

The invention relates to a clip assembly for releasable attachment to a body. The assembly comprises a clip member mounted on an attachment member which is configured for insertion into a corresponding recess provided in the body. The assembly further comprises urging means which bias the clip member towards the body and also biases the attachment member into locking engagement in the recess.

(FIG. 1)

10 Claims, 3 Drawing Sheets

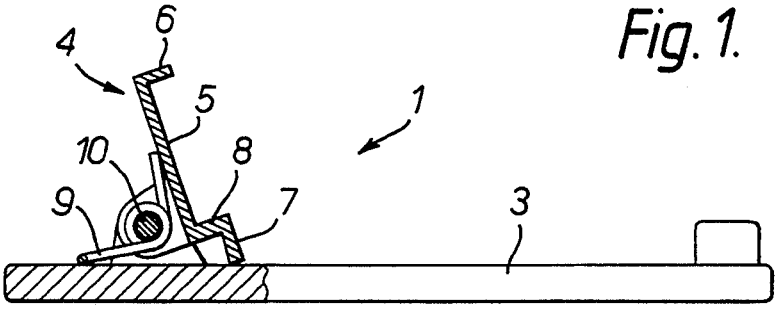
Fig. 1.
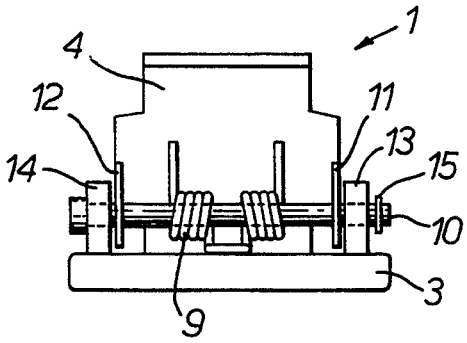
Fig. 2.
Fig. 3.
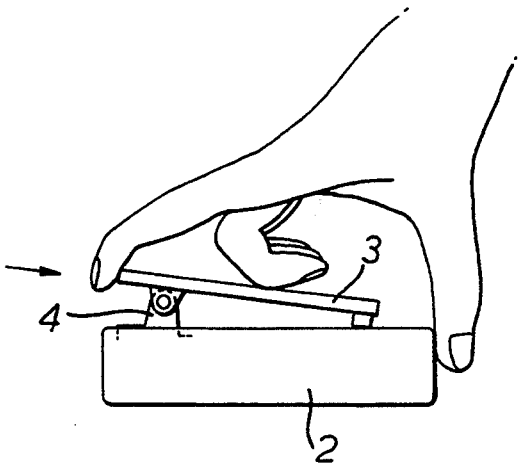
Fig. 4.
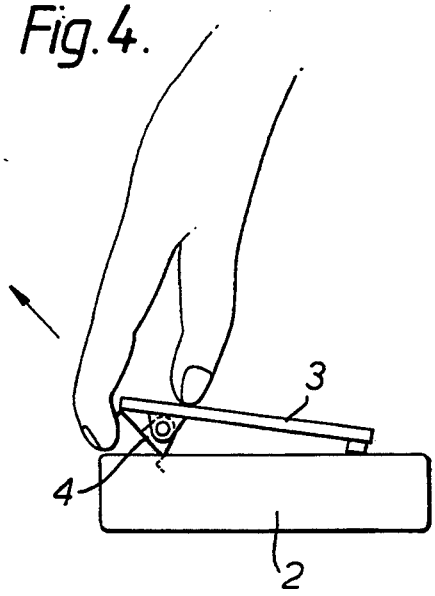

CLIP ASSEMBLY

The invention relates to a clip assembly, for releasable attachment to a body.

BACKGROUND OF THE INVENTION

By means of a clip assembly a small portable electronic device, primarily a paging device, can be fastened to a belt or some other piece of clothing, such as a pocket. However, the clip assembly is not limited to use with such devices.

Clip assemblies for use with small portable electronic devices are known from, for example, U.S. Pat. No. 4,635,836. In this prior-art arrangement the clip section is pivotally mounted by means of a shaft to a support section, which is detachably fastened to a paging device. The support section is structurally very complicated, comprising a number of separate parts. The ends of the support section are secured by fastening means to the upper and lower sections of the paging device. The length of the support section in this case corresponds to the height of the paging device, and as a result of this there is little space left on the back of the paging device for stickers, for example. Furthermore, the manufacture of this large-sized support section requires a larger than desirable amount of material.

SUMMARY OF THE INVENTION

According to the present invention there is provided a clip assembly for releasable attachment to a body, comprising an attachment member, a clip member pivotally mounted on the attachment member, the attachment member being configured for releasable insertion into a complementary recess provided in the body, and means for biasing the clip member towards the body characterized in that the means for biasing the clip member also biases the attachment member into locking engagement in the recess.

An advantage of the present invention is the provision of a clip assembly which is structurally simple and which is easy to install on and remove from the body, and which is easy to assemble. Another advantage of the invention is the provision of an attachment member which is made of one piece of material and which is small, thus permitting he fastening of, for example, stickers to the back of the housing of the paging device.

BRIEF DESCRIPTION OF THE INVENTION

Embodiments of the invention are described below in greater detail, by way of example, with reference to the accompanying drawings, in which:

FIG. 1 is a side view of one clip assembly according to the invention,

FIG. 2 is an end view of the clip assembly of FIG. 1,

FIG. 3 is a side view of the clip assembly FIG. 1, installed on a body,

Figure 5:
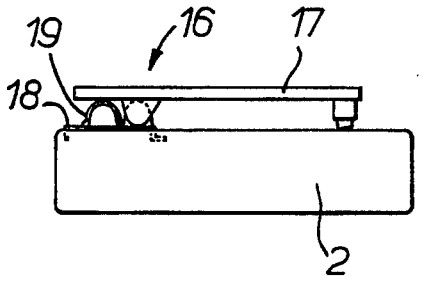
Figure 6:
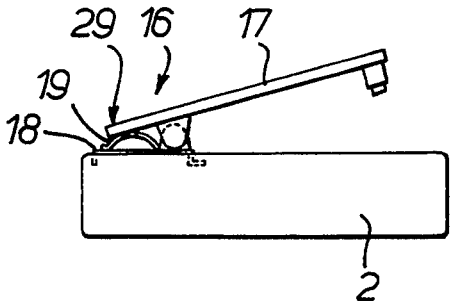
Figure 7:
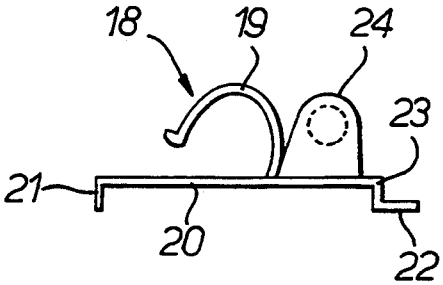
Figure 8:
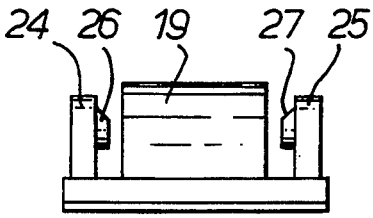
Figure 9:
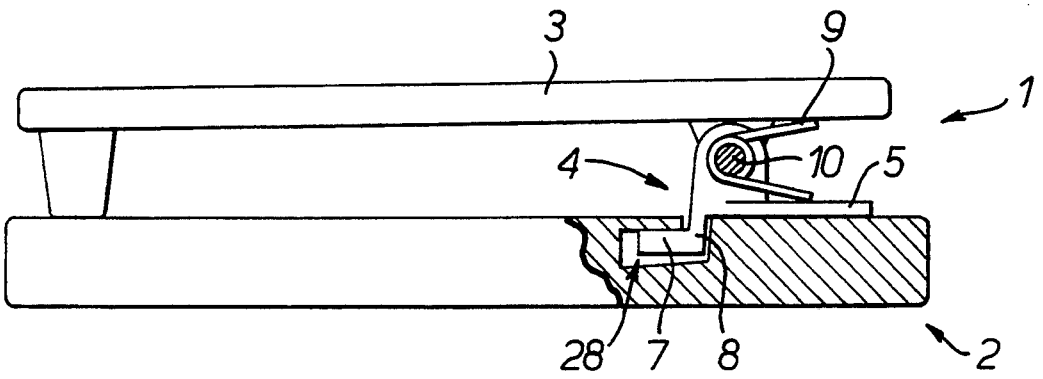
Figure 10:
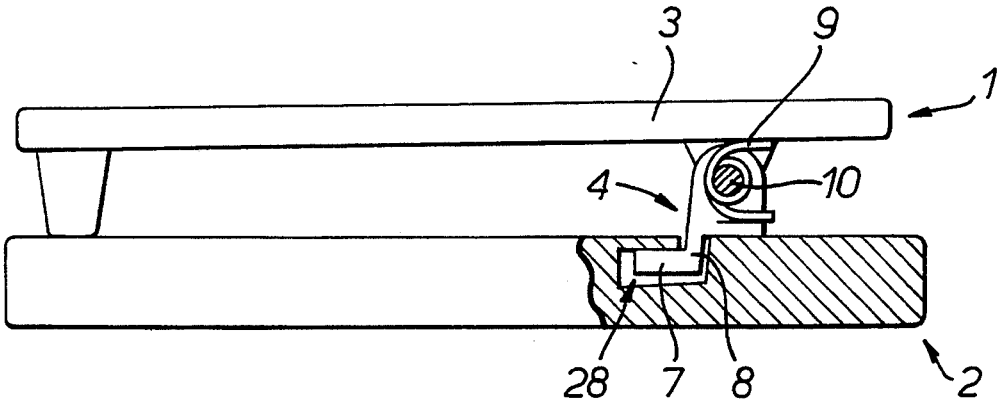

FIG. 4 is a side view of he clip assembly of FIG. 3 showing the clip being detached from the body, FIG. 5 is a side view of another clip assembly according to the invention, installed on a body, FIG. 6 is a side view of the clip assembly of FIG. 5, in another operating position, FIG. 7 is a side view of a portion of the clip assembly of FIG. 5, FIG. 8 is an end view of the portion of the clip assembly of FIG. 7, FIG. 9 is a side view of another clip assembly installed on a body, and FIG. 10 is a side view of yet another clip assembly installed on a body.

DETAILED DESCRIPTION OF THE DRAWINGS

FIGS. 1 to 10 illustrate the whole or part of four embodiments of a clip assembly 1 for releasable attachment to a body 2, such as a portable paging device. The assembly 1 comprises an attachment member or support section 4, pivotally mounted on a clip member or clip section 3. The support section 4 is configured for releasable insertion into a complementary recess 28 provided in the body 2. The assembly 1 further comprises means for biasing the clip section 3 in the form of a spring 9,19 for biasing the clip section 3 towards the body 2. The means for biasing the clip section 3 also biases the support section 4 into locking engagement in the recess 28.

The spring 9,19 urges the clip section 3 towards the body 2 until its motion is stopped either by contact with the body 2 or by a greater force excerted on the upper portion 29 (FIG. 6) of the clip section 3 by the user when opening the clip for attachment to, for example, a garment (not shown). When the spring 9,19 can not move the clip section 3 it urges the support section 4 into contact with the body 2.

In FIGS. 1 and 2, the clip assembly 1 comprises a clip member or clip section 3, an attachment member or support section 4, and a urging means in the form of a torsion spring 9. The clip section 3 is pivotally mounted on the support section 4 by means of a shaft 10.

The clip section 3 is preferably made of a plastic material, and has two parallel fastening lugs 13 and 14, each having a hole to receive the shaft 10 when mounted.

The support section 4, which may preferably be made of either a plastic material or a metal, comprises a substantially flat part 5, one end of which is bent by approximately 90° to form the first fastening means 6. The other end of the flat part 5 is bent by approximately 90° to form a transverse part 7. A part 8 of the transverse part 7 is bent by approximately 90° in the opposite direction to the first bend. Thus the end part 7 is substantially parallel to the flat part 5 and offset by the length of part 8. The support section 4 also has two parallel fastening lugs 11 and 12, each having a hole for the shaft 10 as in the clip section 3.

The clip assembly 1 is assembled by fitting the fastening lugs 11 and 12 of the support section 4 between the fastening lugs 13 and 14 of the clip section 3 in such a manner that the holes are in alignment. The spring 9 is fitted between the fastening lugs 11 and 12. Then the shaft 10 is passed through the holes in the fastening lugs 11–14, and ultimately a looking ring 15 is fitted at one end of the shaft 10.

The length of the flat part 5 of the support section 4 is considerably smaller than the length of the clip section 3. The length of the flat part 5 of the support section 4 is preferably approximately ½–1/10 of the length of the clip section 3.

In FIG. 3, the clip 1 is installed on a body 2 such as a paging device. The back of the body 2 has recesses (not shown in the figure) for the first fastening means 6 and the second fastening means 7 and of the support section 4.

FIGS. 3 and 4 show how the clip assembly 1 is detached from the paging device 2. First the clip section 3 is pushed, using the forefinger, in the direction of the arrow, whereupon the first fastening means 6 rises out of the recess (FIG. 3). Next, the fastening means 6 and the clip section 3 are gripped using the thumb and the forefinger, and they are pulled in the direction of the arrow until the clip detaches from the paging device. The clip 1 is reinstalled on the paging device 2 by a reverse procedure.

FIGS. 5–8 depict another clip 16 according to the invention, having a snap-on joint 26,27 instead of a shaft 10 and locking ring, and a leaf spring 19 instead of a torsion spring 9.

In FIG. 5, the clip 16 is in,tailed on a body 2 such as a paging device. The back of the body 2 has recesses (not shown in the figure) for the first fastening means 21 and the second fastening means 22 and 23 of the support section 18 (see FIG. 7). The clip section 17 is mounted to the support section 18 by means of a snap-on joint. The leaf spring 19 acts on the clip section 17. The leaf spring 19 is attached to the support section 18 and is made of the same material as the support section, for example of a plastic material or a metal.

FIG. 6 shows the same structure as FIG. 5, but in it the clip section 17 is in the open position.

FIGS. 7 and 8 show the structure of the support section 18 in greater detail. The support section 18 comprises a flat part 20, one end of which has the first fastening means 21 and the other end the second fastening means 22 and 23. The support section 18 also has a leaf spring 19. The support section 18 additionally has two parallel fastening lugs 24 and 25, each of them having an inwardly oriented short bevelled pin 26 and 27. The clip section 17 respectively has two parallel fastening lugs, each of them having a hole/recess for the said pins 24 and 25. The clip 16 is assembled simply by snapping the clip section 17 and the support section 18 together.

FIG. 9 illustrates another embodiment of the present invention in which the attachment member or support section 4 does not include a first fastening means 6.

FIG. 10 illustrates yet another embodiment of the present invention in which the attachment member or support section also does not include a flat part 5 as described above.

In view of the foregoing it will be clear to a person skilled in the art that modifications may be incorporated without departing from the scope of the present invention.

We claim:

1. A clip assembly for releasable attachment to a body, comprising;

an attachment member;

a clip member pivotally mounted on the attachment member, the attachment member being configured for releasable insertion into a complementary recess provided in the body;

and means bearing mutually against said attachment member and said clip member for biasing the clip member towards the body characterized in that the means for biasing the clip member also biases the attachment member into locking engagement in the recess.

2. A clip assembly as claimed in claim 1, wherein the attachment member comprises a substantially L shaped portion for insertion into the recess.

3. A clip assembly as claimed in claim 1, wherein the attachment member comprises a limb which bears against the body when the attachment member is engaged in the recess.

4. A clip assembly as claimed in claim 3, wherein the limb comprises a member which engages the body when the attachment member is engaged in the recess.

5. A clip assembly as claimed in claim 1, wherein the biasing means is a torsion spring.

6. A clip assembly as claimed in claim 1, wherein the biasing means is a leaf spring.

7. A clip assembly as claimed in claim 1, wherein the clip member is snap fitted on the attachment member.

8. A clip assembly am claimed in claim 1, wherein the clip member and attachment member each comprise a corresponding pair of concentric holes through which a pivot rod is inserted to mount the clip member on the attachment member.

9. A portable apparatus comprising a body having a recess adapted to receive the attachment member of a clip assembly as claimed in claim 1.

10. A portable apparatus as claimed in claim 9, wherein the recess is configured to enable pivotal movement of he attachment member to facilitate removal of the attachment member from the recess.

* * * * *